US009670722B1

(12) United States Patent
Hall et al.

(10) Patent No.: US 9,670,722 B1
(45) Date of Patent: Jun. 6, 2017

(54) LEVER ARM ASSEMBLY FOR A WINDOW COVERING

(71) Applicants: David R. Hall, Provo, UT (US); Emily Brimhall, Alpine, UT (US)

(72) Inventors: David R. Hall, Provo, UT (US); Emily Brimhall, Alpine, UT (US)

( * ) Notice: Subject to any disclaimer, the term of this patent is extended or adjusted under 35 U.S.C. 154(b) by 0 days.

(21) Appl. No.: 15/072,562

(22) Filed: Mar. 17, 2016

(51) Int. Cl.
*E06B 9/323* (2006.01)

(52) U.S. Cl.
CPC ..... *E06B 9/323* (2013.01)

(58) Field of Classification Search
CPC ..... E06B 9/323
USPC ..... 160/168.1 R, 173 R, 178.1 R, 902; 248/200.1, 265, 269, 270, 271, 272
See application file for complete search history.

(56) References Cited

U.S. PATENT DOCUMENTS 2,181,101 A * 11/1939 Spenard ..... E06B 9/325 160/178.1 R
2,222,674 A * 11/1940 Lorentzen ..... E06B 9/323 160/178.1 R
2,435,373 A * 2/1948 Van Buren ..... E06B 9/323 160/167 R
3,169,006 A * 2/1965 Lorentzen ..... E06B 9/323 248/262
4,444,239 A * 4/1984 Haines ..... E06B 9/30 160/107
4,541,469 A * 9/1985 Dressell ..... B60J 1/2088 160/178.1 R
4,601,319 A * 7/1986 Georgopoulos ..... B60J 1/2088 160/178.1 R
4,782,882 A * 11/1988 Amedeo ..... E06B 9/323 160/178.1 R
4,848,432 A * 7/1989 Connolly ..... E06B 9/174 160/178.1 R
5,460,215 A * 10/1995 Schon ..... E06B 9/262 160/178.1 R
6,186,214 B1 * 2/2001 Ladd ..... E06B 9/325 160/168.1 R
6,722,414 B2 * 4/2004 Nien ..... E06B 9/323 160/123
7,549,615 B2 * 6/2009 Shevick ..... E06B 9/266 160/168.1 R
2014/0086676 A1 * 3/2014 Coker ..... E06B 9/323 403/326

* cited by examiner

*Primary Examiner* — David Purol

(57) ABSTRACT

An apparatus for installing a window covering is disclosed. In one embodiment, such an apparatus includes a stationary portion for attachment to an end of a headrail of a window covering, and a moveable portion to contact an inside of a window casing. A crankshaft is provided that, when rotated, translates the moveable portion relative to the stationary portion. A lever arm is provided to rotate the crankshaft member. A corresponding method is also disclosed and claimed herein.

18 Claims, 7 Drawing Sheets

LEVER ARM ASSEMBLY FOR A WINDOW COVERING

BACKGROUND

Field of the Invention

This invention relates to systems and methods for installing window coverings and other window coverings.

Background of the Invention

Window coverings and other similar window coverings are typically installed in windows using mounting brackets that are screwed into the upper corners of window casings. Although effective, this installation technique may require a user to make measurements to ensure that the brackets are installed in the correct locations, as well as require tools (e.g., drills, screwdrivers, etc.) to drive the screws into the window casing. Unfortunately, this installation technique may also leave unsightly holes in the window casing and potentially damage the paint or finish thereon. This installation technique can also be quite time consuming. In a home or building containing many windows to be outfitted with window coverings or other window coverings, the installation time may increase accordingly.

In order to reduce the amount of time and/or effort needed to install window coverings, installation techniques have been developed. One such technique involves placing spring-loaded mounting brackets at the end of a window covering headrail. When the window covering headrail is placed into a window casing, the spring-loaded mounting brackets are released to provide a compression fit between the window covering and the window casing. Unfortunately, in some cases, such springs may generate insufficient force to secure the window covering to the window casing, particularly with long or heavy window coverings. This can result in movement or creep of the window covering relative to the window casing.

In view of the foregoing, what is needed are improved systems and methods to securely install window coverings in window casings. Ideally, such systems and methods will eliminate and/or reduce the need for tools when installing window coverings. Such systems and methods will also ideally eliminate and/or reduce the need for screws or other fasteners when installing window coverings.

SUMMARY

This invention has been developed in response to the present state of the art and, in particular, in response to the problems and needs in the art that have not yet been fully solved by currently available systems and methods. Accordingly, improved systems and methods have been developed to install window coverings. Features and advantages of different embodiments of the invention will become more fully apparent from the following description and appended claims, or may be learned by practice of the invention as set forth hereinafter.

Consistent with the foregoing, an extensible headrail cap assembly for installing a window covering is disclosed. In one embodiment, a stationary portion for attachment to an end of a headrail of a window covering, and a moveable portion to contact an inside of a window casing is disclosed. A crankshaft member is provided that, when rotated, translates the moveable portion relative to the stationary portion. A lever is provided to rotate the crankshaft member. In certain embodiments, the lever is an arm configured to rotate the crankshaft member. A corresponding method for installation of a window covering is also disclosed and claimed herein.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
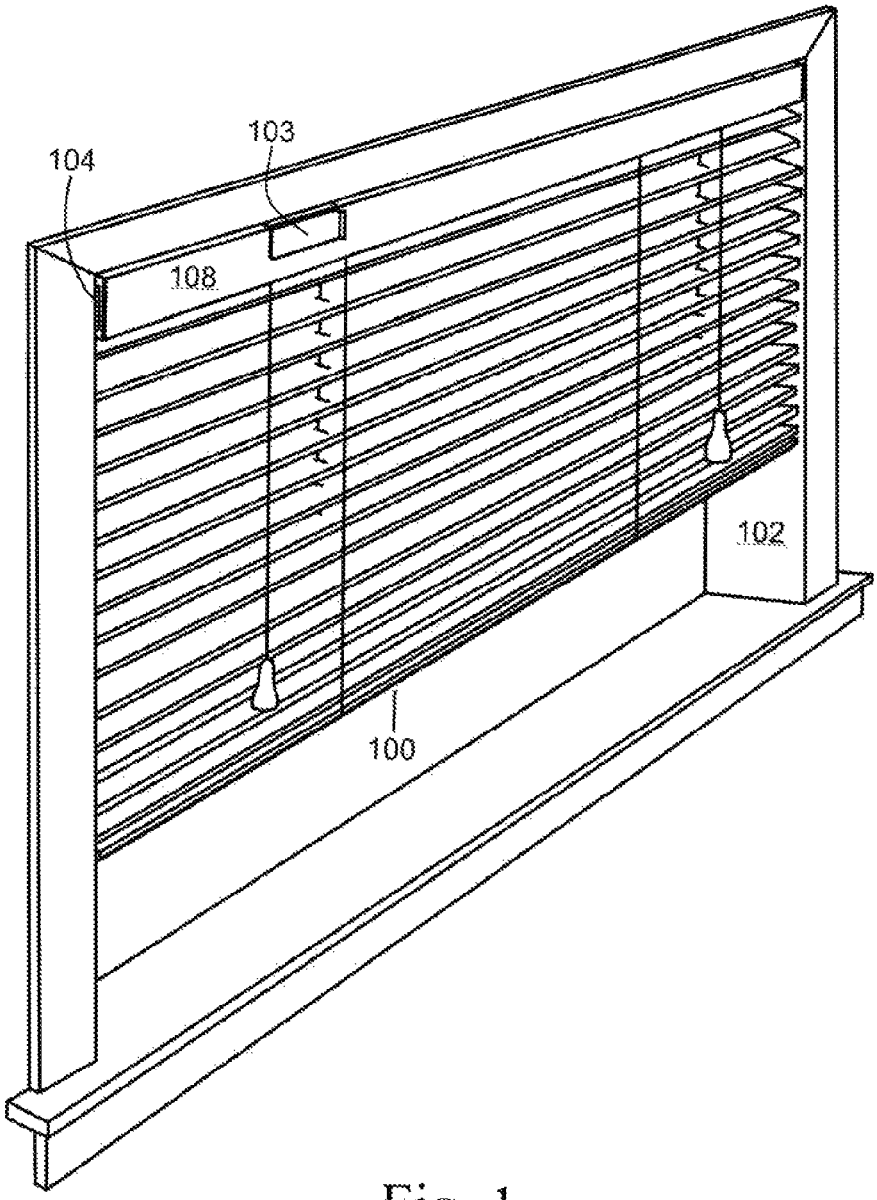
FIG. 1 is a perspective view of one embodiment of a window covering installed using an extensible end cap assembly in accordance with the invention.

Referring to FIG. 1, a perspective view showing one embodiment of a window covering 100 installed using an extensible end cap assembly 104 in accordance with the invention is illustrated. As shown, the extensible end cap assembly 104 is coupled to an end of a headrail 108 of the window covering 100. The extensible end cap assembly 104 is configured to retain the window covering 100 within a window casing 102 by creating a compression fit between the headrail 108 and the window casing 102. That is, the extensible end cap assembly 104 is configured to extend relative to an end of the headrail 108 to create compression against the inside of the window casing 102, thereby retaining the window covering 100 within the window casing 102. Lever 103 may be used to extend and retract a piston portion of end cap assembly in order to create a compression fit between headrail 108 and window casing 102.

Figure 2:
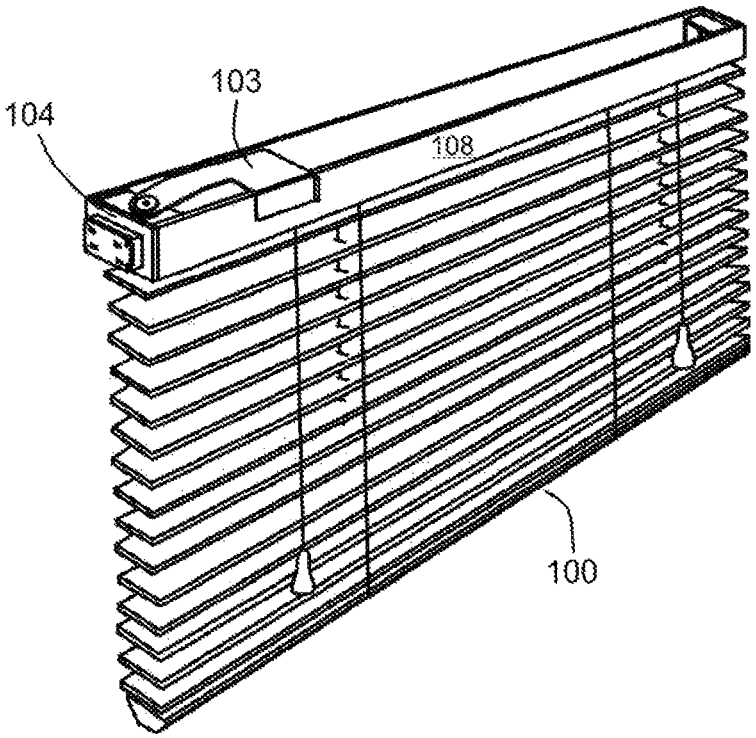
FIG. 2 is a perspective view showing a lever arm for actuating an extensible end cap assembly.

FIG. 2 shows the window covering 100 removed from the window casing 102, with the extensible end cap assembly 104 installed in an end thereof. As shown, the extensible end cap assembly 104 may, in certain embodiments, slide into an end of the headrail 108. In other embodiments, the extensible end cap assembly 104 slides over the end of the headrail 108, such as in cases where the end of the headrail 108 is closed. The extensible end cap assembly 104 may be sized to fit snugly within the headrail 108. The extensible end cap assembly 104 may also be provided in different sizes to accommodate headrails 108 of different dimensions. In other embodiments, the extensible end cap assembly 104 may include different adapters to fit different sizes of headrails 108, thereby allowing a uniform-size extensible end cap assembly 104 to be installed in different size headrails 108. Lever arm 103 may be used to extend and retract a piston portion of end cap assembly in order to create a compression fit between headrail 108 and window casing 102.

Figure 3A:
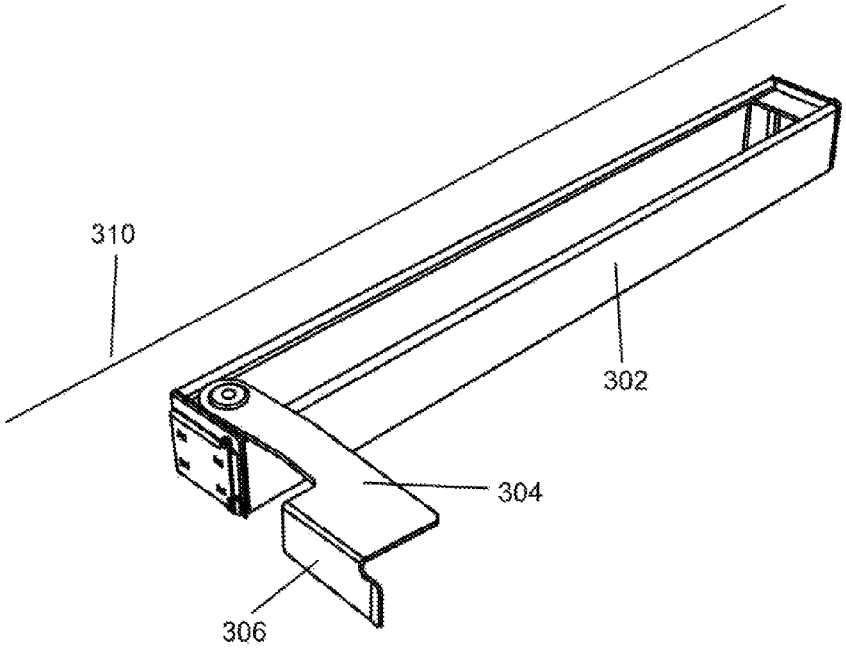
FIGS. 3A and 3B are perspective views showing lever arms of an end cap assembly in extended and retracted positions.
Figure 3B:
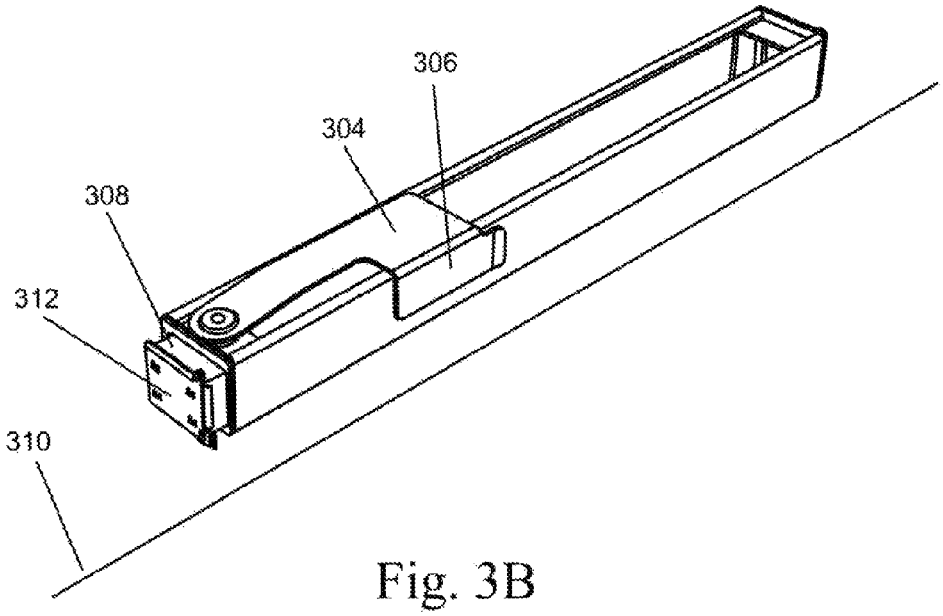

FIGS. 3A and 3B show an embodiment of an extensible end cap assembly 104, in this case a thumb-wheel-style extensible end cap assembly, in a retracted position (FIG. 3A) and in an extended position (FIG. 3B). FIG. 3A depicts a lever arm 304 which is in a substantially perpendicular position compared to a headrail 302 and to a horizontal headrail axis 310. FIG. 3B depicts a lever arm 304 which is in a substantially parallel position compared to a headrail 302 and to a horizontal headrail axis 310. When lever arm 304 is in its parallel position end cap assembly is in an extended position as shown in FIG. 3B. In FIG. 3B we can clearly see a movable portion 308 which is like a piston. When lever arm 304 is rotated a crankshaft member (shown in FIG. 7) rotates and moves piston portion 308 creating a compression fit between the headrail 108 and the window casing 102. A mounting bracket 312 slides onto movable portion 308 and will be described in greater detail in reference to FIG. 4.

Figure 4A:
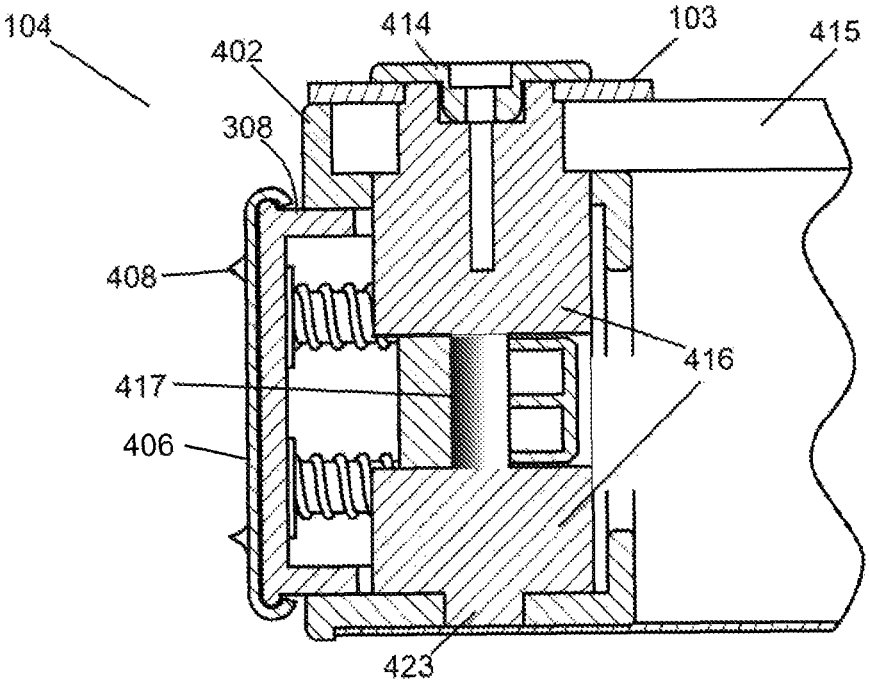
FIGS. 4A and 4B are cross-sectional side views of an end cap assembly in extended and retracted positions.
Figure 4B:
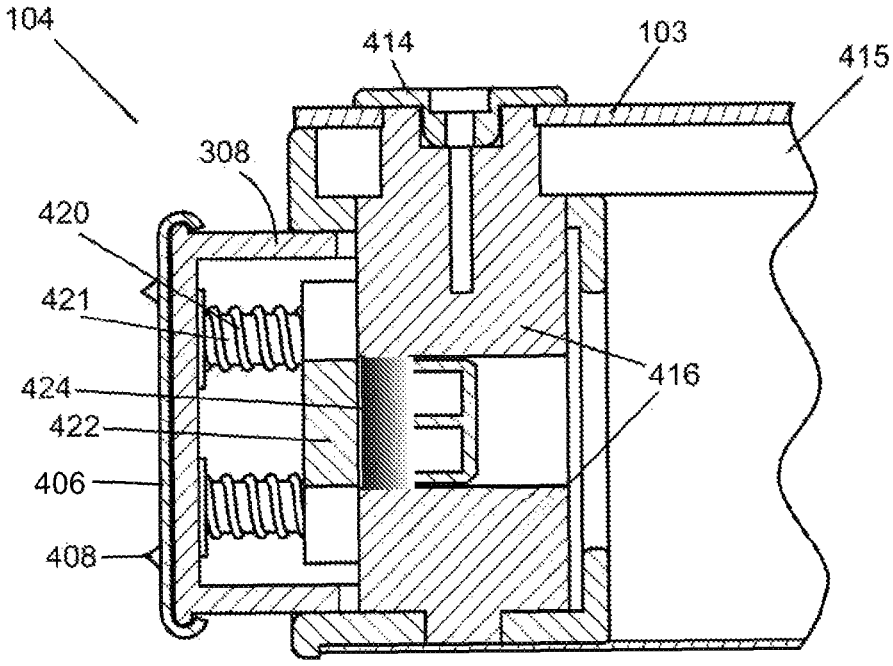

FIGS. 4A and 4B show a close-up cross-sectional view of the inside of the extensible end cap assembly 104. As shown, the extensible end cap assembly 104 includes a stationary portion 402 and a moveable portion 308. The stationary portion 402 may be fixed to an end of the headrail 415. The moveable portion 308 may extend from the stationary portion 402 to contact a window casing 102. A crankshaft 416 and 417 may translate the moveable portion 308 relative to the stationary portion 402. In the illustrated embodiment, a lever arm 103 is used to turn the crankshaft member and thereby translate the moveable portion 308 relative to the stationary portion 402. This lever arm may be rotated by hand one quarter turn or 90 degrees. FIG. 4A shows a crankshaft in a retracted rotational position 417 with movable portion 308 also in a retracted position. FIG. 4B shows the same crankshaft rotated 90 degrees and now in position 424 with the movable portion 308 now in an extended position. When lever arm 103 is in a parallel position, the movable portion 308 is in an extended position. In FIGS. 4A and 4B we also see a floating bearing member 422 which is shown more clearly in FIG. 6A. Floating bearing 422 floats along guide pins 421 and is positioned partially by springs 420. Fixing member 414 fixes lever arm 103 to crankshaft 416.

As shown in FIG. 4, the moveable portion 308 may, in certain embodiments, include a mounting bracket 406 that allows the window covering 100 to be removed and reinstalled after its initial installation. A corresponding mounting bracket 406 may be provided on a fixed-length end cap assembly 104. The mounting bracket 406 may, in certain embodiments, be coated with an adhesive 506 (FIG. 5). When installing a window covering 100 in a window casing 102, the mounting bracket 406 may be adhered to the window casing 102 at a desired location. The lever arm 103 may then be rotated to create a compression fit between the window covering 100 and the window casing 102. This will press the adhesive 506 (FIG. 5) against the window casing 102 to improve the bond therebetween.

In certain embodiments, the mounting bracket 406 may also be designed with one or more spikes 408, barbs 408, cleats 408, or the like, to penetrate the window casing 102 as compression increases between the extensible end cap assembly 104 and the window casing 102. The adhesive 506 (FIG. 5) in combination with the spikes 408, barbs 408, or cleats 408 may improve the bond with the window casing 102. Once the mounting bracket 406 is attached to the window casing 102, the window covering 100 (along with the remaining portion of the extensible end cap assembly 104) may be removed from the window casing 102 by simply sliding the window covering 100 out of the mounting brackets 406. The mounting brackets 406 may stay in place on the window casing 102. The window covering 100 may be reinstalled by simply sliding the window covering 100 back into the mounting brackets 406. One example of a mounting bracket 406 for use with the extensible end cap assembly 104 and fixed-length end cap assembly 104 is shown in FIG. 6B.

Figure 5A:
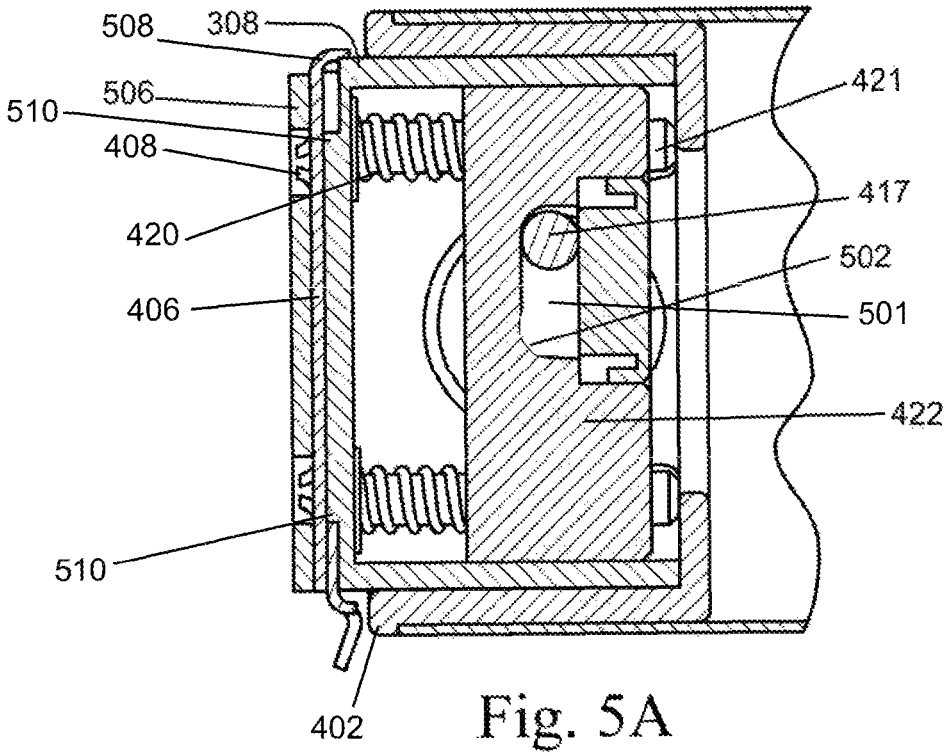
FIGS. 5A and 5B are cross-sectional top views of an end cap assembly in extended and retracted positions.
Figure 5B:
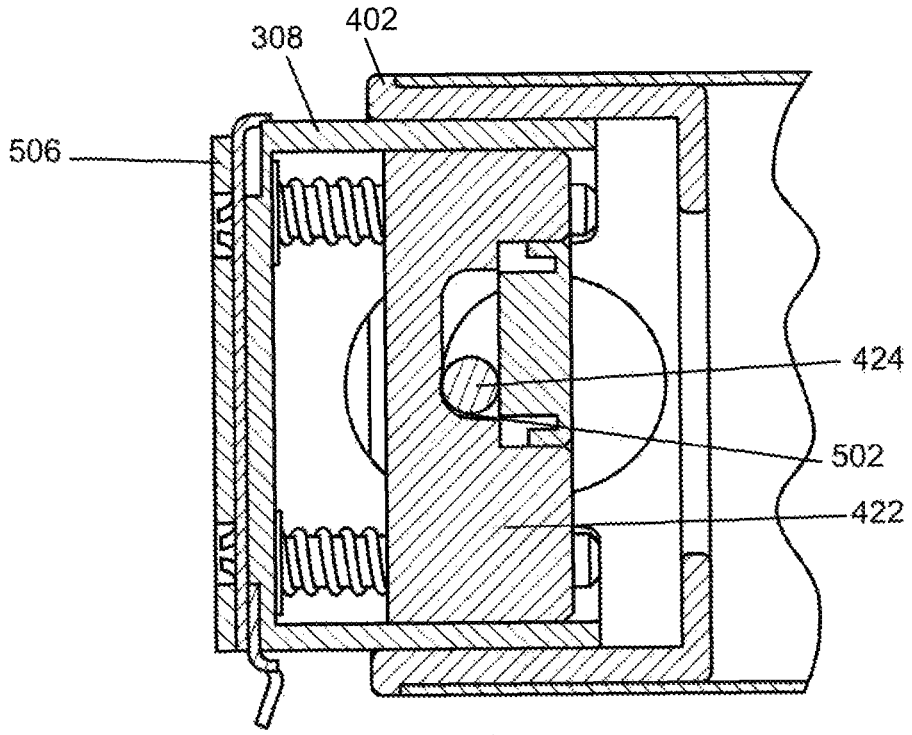

FIGS. 5A and 5B show a cross-sectional top view of the internal workings of the extensible end cap assembly 104 in a retracted and an extended position. The stationary portion 402 and a moveable portion 308 are shown, with the moveable portion 308 moving in a direction relative to the stationary portion 402. Rotation of a crankshaft member 417 translates the moveable portion 308 relative to the stationary portion 402. A lever arm (not shown) is used to manually turn the crankshaft member 417. As further shown, the extensible end cap assembly 104 includes a mounting bracket 406 that enables the window covering 100 to be removed and reinstalled after its initial installation. In the illustrated embodiment, the mounting bracket 406 includes curved ends 508 that provide a track for sliding the thumb-wheel-style extensible end cap assembly 104 into and out of the mounting bracket 406. Ridges 510 on the moveable portion 400 of the thumb-wheel-style extensible end cap assembly 104 may be configured to slide in this track. As further shown, the mounting bracket 406 may be coated with an adhesive 412 to adhere the mounting bracket 406 to a window casing 102. The mounting bracket 406 is also configured with one or more spikes 408, barbs 408, cleats 408, or the like, to penetrate the window casing 102 and prevent slippage between the window casing 102 and the thumb-wheel-style extensible end cap assembly 104. FIG. 5A shows a crankshaft in a retracted rotational position 417 with movable portion 308 also in a retracted position. FIG. 5B shows the same crankshaft rotated 90 degrees and now in position 424 with the movable portion 308 now in an extended position. Floating bearing 422 contains a track 501 for crankshaft member 417 to move in. The track contains a surface 502 which is grooved or inset more than the rest of the track 501 and is configured such that crankshaft member 417 locks into or is held by grooved surface portion 502 when the lever arm is in a parallel position relative to the horizontal headrail axis 310 and when the end cap assembly is in compression with window casing 102.

Figure 6A:
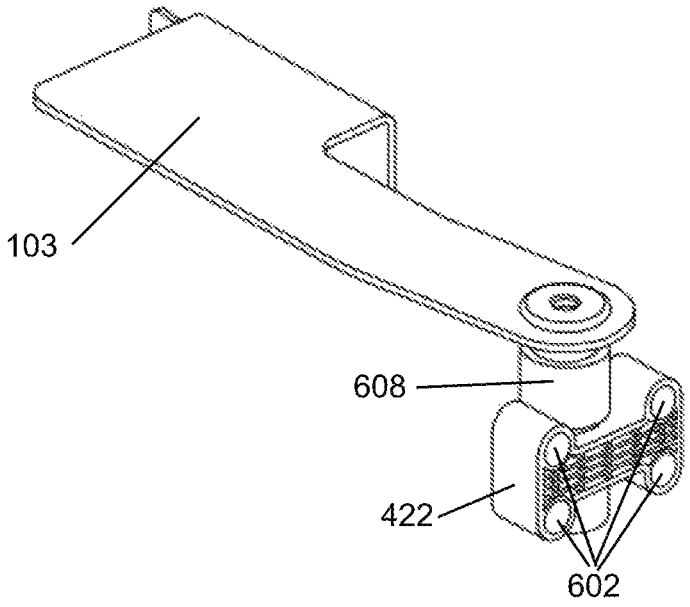
FIGS. 6A and 6B show perspective views of portions of the end cap assembly.
Figure 6B:
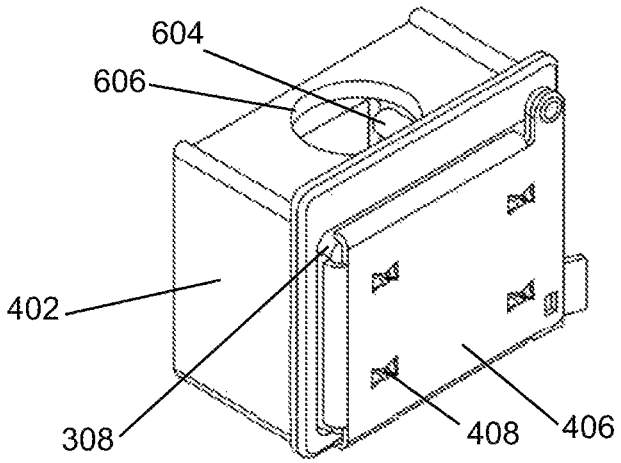

FIGS. 6A and 6B are perspective views of the end cap assembly 104. FIG. 6A shows the lever arm 103 connected to a crankshaft 608. Crankshaft 608 moves floating bearing 422 when the lever arm is rotated. Floating bearing 422 moves along guide pins 421 as the guide pins move inside of holes 602. Springs 420 create a tension between the movable portion 308 and floating bearing 422 by being positioned along the guide pins 421 as shown in FIGS. 4A and 4B and compressing when the head rail is positioned within a window casing and the lever arm is parallel to the horizontal headrail axis 310. FIG. 6B shows stationary portion 402 with a hole 606. Hole 606 holds and positions crankshaft 608. A similar hole in on the opposite side of stationary member 402 exists but is not shown and is used to also hold and position crankshaft 608.

Figure 7:
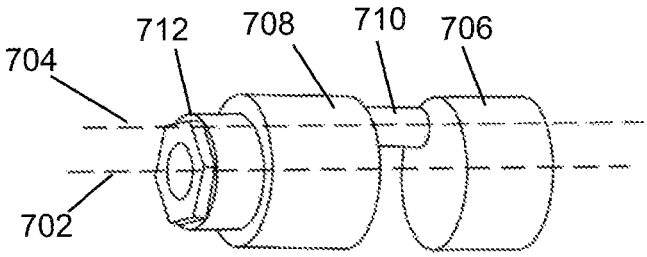
FIG. 7 shows a perspective view of a crankshaft of the end cap assembly.

Referring to FIG. 7, a crankshaft is shown with a first crankshaft member 708 having a center axis 702 and a second crankshaft member 710 having a center axis 704. Center axis 702 and center axis 704 are offset by a predetermined distance relative to each other. As the crankshaft is rotated, the second crankshaft member 710 may push against a floating bearing member 422 to create a compression fit between the headrail 108 and a window casing 102. The lever arm 103 is attached to crankshaft member 712 for enabling rotation of the crankshaft. Crankshaft members 706 and 712 interface with stationary portion 402 allowing for rotation and positioning of crankshaft member 416.

The systems and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A window covering comprising:

a headrail;

a stationary portion that attaches to an end of the headrail of the window covering;

a moveable portion that contacts an inside of a window casing extendable from the stationary portion;

a first crankshaft member that, upon rotation, translates the moveable portion relative to the stationary portion;

a second crankshaft member that, upon rotation, translates the moveable portion relative to the stationary portion, wherein a rotational axis of the first crankshaft member is offset from a rotational axis of the second crankshaft member; and a lever arm attached to the first crankshaft member, wherein as the lever arm is moved the second crankshaft member rotates and pushes against the moveable portion to create a compression fit between the headrail and the window casing by extending the moveable portion away from the end of the headrail.

2. The apparatus of claim 1, wherein rotating the first crankshaft member also rotates the second crankshaft member such that the second crankshaft member locks the first crankshaft member in a tensioned position in the window casing when the lever arm is positioned substantially parallel to the headrail.

3. The apparatus of claim 1, wherein the lever arm is rotated from a substantially perpendicular position relative to a horizontal axis of the headrail to a substantially parallel position relative to the horizontal axis of the headrail in order to create the compression fit between the headrail and the window casing.

4. The apparatus of claim 3, wherein the lever arm comprises a first portion which is planar to a top of the headrail.

5. The apparatus of claim 4, wherein the lever arm further comprises a second portion with is planar to a front of the headrail.

6. The apparatus of claim 1, wherein the moveable portion includes a mounting bracket to enable mounting of the window covering to the inside of the window casing.

7. The apparatus of claim 6, wherein the mounting bracket comprises at least one of spikes, barbs, cleats, and double-sided tape.

8. The apparatus of claim 6, wherein the mounting bracket is configured to remain in place on the window casing after removal of the window covering.

9. The apparatus of claim 8, wherein the moveable portion slides into and out of the mounting bracket.

10. A method for installing a window covering, the method comprising:

providing a stationary portion that attachments to an end of a headrail of the window covering;

contacting an inside of a window casing with a moveable portion;

rotating a lever arm connected to a first crankshaft member in order to translate the moveable portion relative to the stationary portion, wherein rotating the first crank shaft member rotates a second crankshaft member, a rotational axis of the first crankshaft member being offset from a rotational axis of the second crankshaft member, creating a compression fit between the headrail and the window casing.

11. The method of claim 10, wherein rotating the first crankshaft member also rotates the second crankshaft member such that the second crankshaft member locks the first crankshaft member in a tensioned position in the window casing when the lever arm is positioned substantially parallel to the headrail.

12. The method of claim 10, wherein the lever arm is rotated from a substantially perpendicular position relative to a horizontal axis of the headrail to a substantially parallel position relative to the horizontal axis of the headrail in order to create the compression fit between the headrail and the window casing.

13. The method of claim 11, wherein the lever arm comprises a first portion which is planar to a top of the headrail.

14. The method of claim 13, wherein the lever arm further comprises a second portion with is planar to a front of the headrail.

15. The method of claim 10, wherein the moveable portion includes a mounting bracket to enable mounting of the window covering to the inside of the window casing.

16. The method of claim 15, wherein the moveable portion presses at least one of spikes, barbs, and cleats, incorporated into the mounting bracket into the window casing.

17. The method of claim 15, wherein the mounting bracket is configured to remain in place on the window casing after removal of the window covering.

18. The method of claim 17, further comprising removing the window covering by sliding the moveable portion out of the mounting bracket.

* * * * *